US009192832B2

(12) United States Patent
Parsons et al.

(10) Patent No.: US 9,192,832 B2
(45) Date of Patent: Nov. 24, 2015

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Robert R. Parsons, Scottsdale, AZ (US); Bradley D. Schweigert, Anthem, AZ (US); Michael R. Nicolette, Scottsdale, AZ (US)

(73) Assignee: Parsons Xtreme Golf, LLC, Scottsdale, AZ (US)

( * ) Notice: Subject to any disclaimer, the term of this patent is extended or adjusted under 35 U.S.C. 154(b) by 0 days.

(21) Appl. No.: 14/697,430

(22) Filed: Apr. 27, 2015

(65) Prior Publication Data

US 2015/0306477 A1 Oct. 29, 2015

Related U.S. Application Data

(60) Continuation-in-part of application No. 14/586,720, filed on Dec. 30, 2014, and a continuation-in-part of application No. 29/509,762, filed on Nov. 20, 2014, which is a continuation of application No. 29/501,012, (Continued)

(51) Int. Cl.

| | |
|---|---|
| ***A63B 53/06*** | (2015.01) |
| ***A63B 53/04*** | (2015.01) |
| ***A63B 59/00*** | (2015.01) |

(52) U.S. Cl.

CPC ..... *A63B 53/065* (2013.01); *A63B 53/0487* (2013.01); *A63B 59/0074* (2013.01); *A63B 2053/0408* (2013.01); *A63B 2053/0441* (2013.01); *A63B 2053/0491* (2013.01)

(58) Field of Classification Search

CPC ..... A63B 53/0487

See application file for complete search history.

(56) References Cited

U.S. PATENT DOCUMENTS

| | | | | |
|---|---|---|---|---|
| RE19,178 | E * | 5/1934 | Spiker | 473/251 |
| 4,043,562 | A | 8/1977 | Shillington | |
| D350,582 | S | 9/1994 | Miansian et al. | |
| 5,429,366 | A | 7/1995 | McCabe | |
| D363,101 | S | 10/1995 | Sturm | |
| D365,864 | S | 1/1996 | Sturm | |
| 5,489,097 | A | 2/1996 | Simmons | |
| D368,751 | S | 4/1996 | Rife | |
| D378,688 | S | 4/1997 | Cameron | |
| 5,683,307 | A | 11/1997 | Rife | |
| D398,685 | S | 9/1998 | Masuda | |

(Continued)

OTHER PUBLICATIONS

U.S. Appl. No. 29/503,812, Schweigert, "Golf Club Head," filed Sep. 30, 2014.

(Continued)

*Primary Examiner* — Michael Dennis

(74) *Attorney, Agent, or Firm* — Loeb & Loeb LLP

(57) ABSTRACT

Embodiments of golf club heads and methods to manufacture golf club heads are generally described herein. In one example, a golf club head may include a body portion with a toe portion, a heel portion, a rear portion, a front portion with a strike face, a sole portion, and a top portion with a plurality of weight ports. The body portion may define a periphery of the golf club head. The golf club head may also include a plurality of weight portions with each weight portion disposed in one weight port of the plurality of weight ports. Other examples and embodiments may be described and claimed.

20 Claims, 14 Drawing Sheets

Related U.S. Application Data filed on Aug. 29, 2014, now Pat. No. Des. 722,351, application No. 14/697,430, which is a continuation-in-part of application No. 29/511,483, filed on Dec. 11, 2014, which is a division of application No. 29/501,012, filed on Aug. 29, 2014, now Pat. No. Des. 722,351.

(60) Provisional application No. 61/985,351, filed on Apr. 28, 2014, provisional application No. 61/922,379, filed on May 13, 2014, provisional application No. 62/015,297, filed on Jun. 20, 2014, provisional application No. 62/030,820, filed on Jul. 30, 2014, provisional application No. 62/041,553, filed on Aug. 25, 2014.

(56) References Cited

U.S. PATENT DOCUMENTS

| | | | | |
|---|---|---|---|---|
| D399,911 | S | 10/1998 | Nicolette et al. | |
| D405,836 | S | 2/1999 | Nicolette et al. | |
| D409,701 | S | 5/1999 | Ashcraft et al. | |
| 5,924,938 | A | 7/1999 | Hines | |
| D436,151 | S | 1/2001 | Nicolette et al. | |
| D441,820 | S | 5/2001 | Nicolette et al. | |
| D443,668 | S | 6/2001 | Nicolette et al. | |
| D443,905 | S | 6/2001 | Nicolette et al. | |
| D444,833 | S | 7/2001 | Wells et al. | |
| D449,664 | S | 10/2001 | Beebe et al. | |
| D449,865 | S | 10/2001 | Fife et al. | |
| D450,799 | S | 11/2001 | Nicolette et al. | |
| D451,973 | S | 12/2001 | Wells et al. | |
| 6,348,014 | B1 * | 2/2002 | Chiu | 473/337 |
| 6,354,959 | B1 | 3/2002 | Nicolette et al. | |
| D472,949 | S | 4/2003 | Serrano et al. | |
| D474,821 | S | 5/2003 | Wells et al. | |
| D483,086 | S | 12/2003 | Schweigert et al. | |
| D486,872 | S | 2/2004 | Schweigert et al. | |
| D498,276 | S | 11/2004 | Schweigert et al. | |
| 6,902,496 | B2 | 6/2005 | Solheim et al. | |
| 6,988,956 | B2 | 1/2006 | Cover et al. | |
| D520,088 | S | 5/2006 | Parr | |
| D531,242 | S | 10/2006 | Adams | |
| D532,067 | S | 11/2006 | Soracco et al. | |
| 7,153,220 | B2 | 12/2006 | Lo | |
| 7,156,752 | B1 | 1/2007 | Bennett | |
| 7,204,765 | B2 | 4/2007 | Cover et al. | |
| D542,869 | S | 5/2007 | Adams | |
| D543,598 | S | 5/2007 | Kuan et al. | |
| D556,277 | S | 11/2007 | Broom | |
| D561,854 | S | 2/2008 | Morris | |
| 7,331,876 | B2 | 2/2008 | Klein | |
| 7,351,162 | B2 | 4/2008 | Soracco et al. | |
| D569,461 | S | 5/2008 | Morris | |
| D569,930 | S | 5/2008 | Nehrbas | |
| 7,396,289 | B2 | 7/2008 | Soracco et al. | |
| D577,085 | S | 9/2008 | Nicolette et al. | |
| D577,086 | S | 9/2008 | Nicolette et al. | |
| D579,506 | S | 10/2008 | Nicolette et al. | |
| D579,995 | S | 11/2008 | Nicolette et al. | |
| D582,497 | S | 12/2008 | Rollinson | |
| 7,473,189 | B2 | 1/2009 | Schweigert et al. | |
| 7,491,131 | B2 * | 2/2009 | Vinton | 473/251 |
| D599,425 | S | 9/2009 | Laub | |
| 7,744,485 | B2 | 6/2010 | Jones et al. | |
| D620,993 | S | 8/2010 | Laub | |
| D623,709 | S | 9/2010 | Serrano et al. | |
| D631,925 | S | 2/2011 | Broom | |
| 7,887,432 | B2 | 2/2011 | Jones et al. | |
| 7,909,707 | B2 | 3/2011 | Klein | |
| 7,918,745 | B2 | 4/2011 | Morris et al. | |
| D638,891 | S | 5/2011 | Nicolette et al. | |
| D642,643 | S | 8/2011 | Nicolette et al. | |
| D643,485 | S | 8/2011 | Nicolette et al. | |
| D645,104 | S | 9/2011 | Nicolette et al. | |
| 8,096,039 | B2 | 1/2012 | Soracco et al. | |
| D653,718 | S | 2/2012 | Stokke et al. | |
| D666,260 | S | 8/2012 | Cynn | |
| D688,339 | S | 8/2013 | Hilton et al. | |
| D688,341 | S | 8/2013 | Rollinson | |
| D691,226 | S | 10/2013 | Hilton et al. | |
| D699,308 | S | 2/2014 | Rollinson | |
| D704,782 | S | 5/2014 | Rollinson | |
| 8,721,472 | B2 * | 5/2014 | Kuan et al. | 473/341 |
| 8,790,193 | B2 | 7/2014 | Serrano et al. | |
| D722,350 | S | 2/2015 | Schweigert | |
| D722,351 | S | 2/2015 | Parsons et al. | |
| 2007/0142122 | A1 | 6/2007 | Bonneau | |
| 2007/0238548 | A1 | 10/2007 | Johnson | |
| 2008/0176672 | A1 | 7/2008 | Roach et al. | |
| 2011/0165959 | A1 | 7/2011 | Klein | |
| 2013/0165256 | A1 | 6/2013 | Stevenson | |
| 2013/0210537 | A1 | 8/2013 | Ainscough et al. | |

OTHER PUBLICATIONS

U.S. Appl. No. 29/506,381, Schweigert, "Golf Club Head," filed Oct. 15, 2014.

U.S. Appl. No. 29/509,762, Parsons et al., "Golf Club Head," filed Nov. 20, 2014.

U.S. Appl. No. 29/511,483, Parsons et al., "Golf Club Head," filed Dec. 11, 2014.

U.S. Appl. No. 29/512,255, Schweigert, "Golf Club Head," filed Dec. 17, 2014.

U.S. Appl. No. 29/512,512, Schweigert, "Golf Club Head," filed Dec. 19, 2014.

U.S. Appl. No. 29/512,516, Schweigert, "Golf Club Head," filed Dec. 19, 2014.

U.S. Appl. No. 14/586,720, Parsons et al., "Golf Club Heads and Methods to Manufacture Golf Club Heads," filed Dec. 30, 2014.

U.S. Appl. No. 29/518,697, Schweigert, "Golf Club Head," filed Feb. 26, 2015.

U.S. Appl. No. 14/686,466, Schweigert, "Golf Club Head," filed Apr. 14, 2015.

* cited by examiner

GOLF CLUB HEADS AND METHODS TO MANUFACTURE GOLF CLUB HEADS

CROSS REFERENCE

This application claims the benefit of U.S. Provisional Application No. 61/985,351, filed Apr. 28, 2014, U.S. Provisional Application No. 61/992,379, filed May 13, 2014, U.S. Provisional Application No. 62/015,297, filed Jun. 20, 2014, and U.S. Provisional Application No. 62/030,820, filed Jul. 30, 2014. This application is a continuation-in-part application of U.S. application Ser. No. 14/586,720, filed Dec. 30, 2014, which claims the benefits of U.S. Provisional Application No. 62/041,553, filed Aug. 25, 2014. This application is also a continuation-in-part application of U.S. application Ser. No. 29/509,762 filed Nov. 20, 2014, which is a continuation application of U.S. Application Serial No. 29/501,012 filed Aug. 29, 2014. This application is also a continuation-in-part application of U.S. application Ser. No. 29/511,483, filed Dec. 11, 2014, which is a divisional application of U.S. application Ser. No. 29/501,012, filed Aug. 29, 2014. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Proper alignment of a golf club head at an address position relative to a golf ball may improve the performance of an individual. Various alignment aids have been used on the golf club heads to improve the individual's visual alignment.

Figure 1:
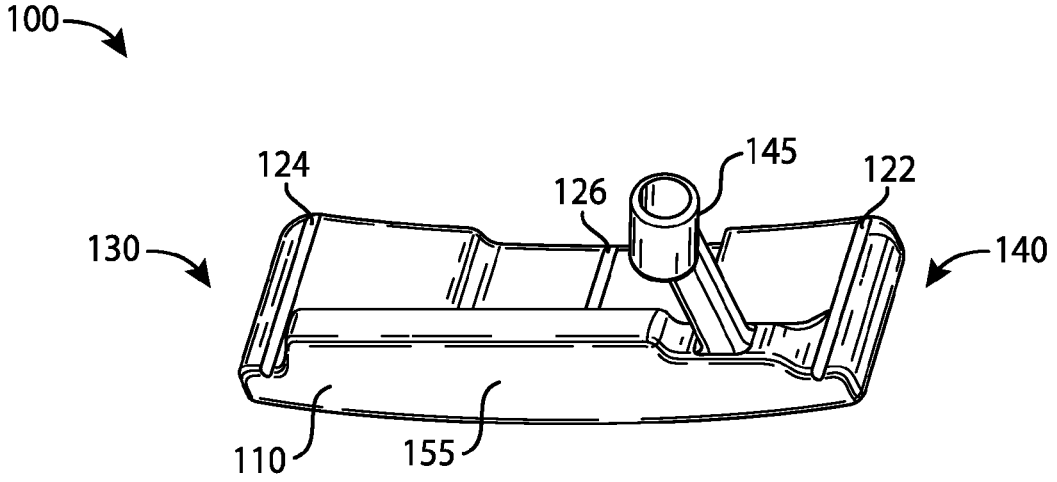
FIG. 1 depicts a front perspective view of a golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

In the example of FIGS. 1-10, a golf club head 100 may include a body portion 110, and a visual guide portion 120, generally shown 122, 124, and 126. The body portion 110 may include a toe portion 130, a heel portion 140, a front portion 150, a rear portion 160, a top portion 170, and a sole portion 180. The body portion 110 may be manufactured via various manufacturing methods and/or processes (e.g., a casting process, a forging process, a milling process, a cutting process, a grinding process, a welding process, a combination thereof, etc.). The body portion 110 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 110 may be partially or entirely made of non-metal material (e.g., composite, plastic, etc.). The golf club head 100 may be a putter-type golf club head (e.g., a blade-type putter, a mid-mallet-type putter, a mallet-type putter, etc.). Based on the type of putter as mentioned above, the body portion 110 may be at least 200 grams. For example, the body portion 110 may be in a range between 300 to 600 grams. Although FIGS. 1-10 may depict a particular type of club head, the apparatus, methods, and articles of manufacture described herein may be applicable to other types of club heads (e.g., a driver-type club head, a fairway wood-type club head, a hybrid-type club head, an iron-type golf club head, etc.). The apparatus, methods, and articles of manufacture described herein are not limited in this regard.

The toe and heel portions 130 and 140, respectively, may be on opposite ends of the body portion 110. The heel portion 140 may include a hosel portion 145 configured to receive a shaft (not shown) with a grip (not shown) on one end and the golf club head 100 on the opposite end of the shaft to form a golf club. Alternatively, the heel portion 140 may include a bore portion to receive the shaft (one shown as 1245 in FIGS. 11-13). The toe and heel portions 130 and 140, respectively, may define a width of the body portion 110.

In a similar manner, the front and rear portions 150 and 160, respectively, may be on opposite ends of the body portion 110. The front portion 150 may include a face portion 155 (e.g., a strike face). The face portion 155 may be used to impact a golf ball (one shown as 500 in FIG. 5). The face portion 155 may be an integral portion of the body portion 110. Alternatively, the face portion 155 may be a separate piece or an insert coupled to the body portion 110 via various manufacturing methods and/or processes (e.g., a bonding process, a welding process, a brazing process, a mechanical locking method, a mechanical fastening method, any combination thereof, or other suitable types of manufacturing methods and/or processes). The face portion 155 may be associated with a loft plane that defines the loft angle of the golf club head 100. The front and rear portions 150 and 160, respectively, may define a length of the body portion 110 (shown as 920 in FIG. 9). The apparatus, methods, and articles of manufacture described herein are not limited in this regard.

In one example, the visual guide portion 120 may include a first visual guide portion 122, and a second visual guide portion 124. The first and second visual guide portions 122 and 124, respectively, may extend between the front and rear portions 150 and 160, respectively. For example, the first and second visual guide portions 122 and 124, respectively, may extend the length of the body portion 110. The first and second visual guide portions 122 and 124, respectively, may be substantially congruent (e.g., same length). Alternatively, the first and second visual guide portions 122 and 124, respectively, may have different lengths. That is, the first visual guide portion 122 may be longer than the second visual guide portion 124 or vice versa. The apparatus, methods, and articles of manufacture described herein are not limited in this regard.

The visual guide portion 120 may include a solid line portion, a dashed line portion, a dotted line portion, or any combination thereof. As shown in the figures, for example, the first and second visual guide portions 122 and 124, respectively, may be solid line portions. The visual guide portion 120 may include a colored line portion, a raised line portion, a recessed line portion, a laser-etched line portion, or any combination thereof. For example, the first and second visual guide portions 122 and 124, respectively, may be colored and recessed line portions (e.g., including a contrast layer relative to the body portion 110). The first and second visual guide portions 122 and 124, respectively, may be the same color, which may be different than the color of the body portion 110 (e.g., two contrasting colors). For example, the first and second visual guide portions 122 and 124, respectively, may be a white color whereas the body portion 110 may be a black color (e.g., a black-nickel chrome). Alternatively, the body portion 110 and/or the visual guide portions 120 may be manufactured with different methods and/or processes so that the body portion 110 and the visual guide portion 120 may have contrasting finishes. For example, the body portion 110 may have a black-nickel chrome finish whereas the first and second visual guide portions 122 and 124, respectively, may have a stainless-steel finish. While the above examples may describe the first and second visual guide portions 122 and 124, respectively, having the same color, the first and second visual guide portions 122 and 124, respectively, may have different colors. The apparatus, methods, and articles of manufacture described herein are not limited in this regard.

Figure 2:
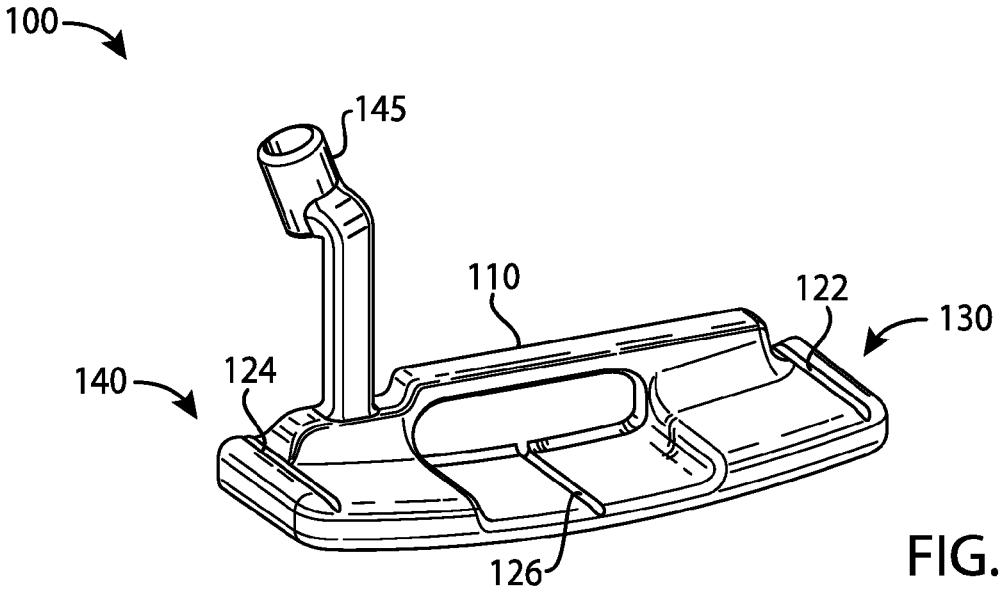
FIG. 2 depicts a rear perspective view of the example golf club head of FIG. 1.
Figure 3:
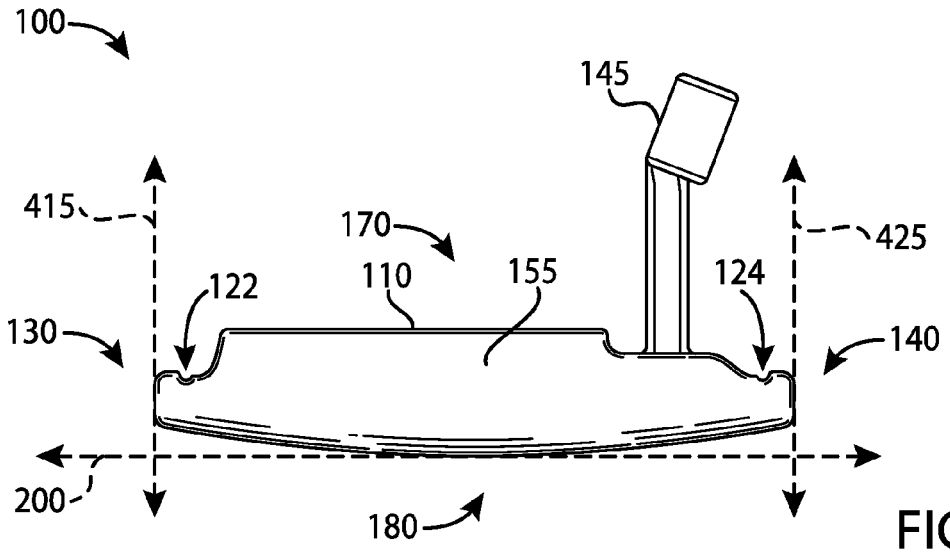
FIG. 3 depicts a front view of the example golf club head of FIG. 1.
Figure 4:
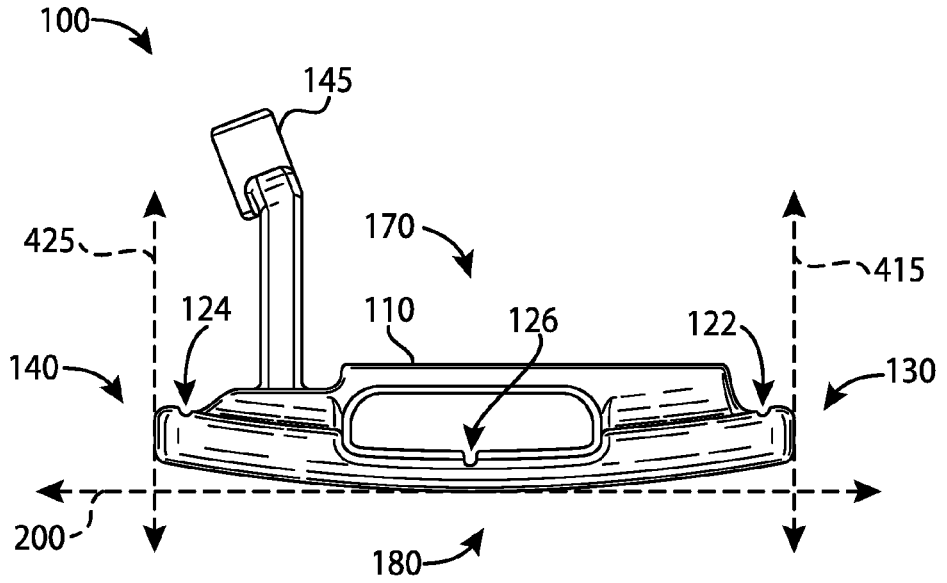
FIG. 4 depicts a rear view of the example golf club head of FIG. 1.

Further, the first and second visual guide portions 122 and 124, respectively, may be substantially parallel to each other. The first and second visual guide portions 122 and 124, respectively, may be separated by at least 1.68 inches. The first visual guide portion 122 may be located at or proximate to the toe portion 130 whereas the second visual guide portion 124 may be located at or proximate to the heel portion 140. For example, the first visual guide portion 122 may be located less than one inch from an outer edge of the toe portion 130 whereas the second visual guide portion 124 may be located less than one inch from an outer edge of the heel portion 140. In particular, the toe portion 130 may be associated with a toe end point 135, and the heel portion 140 may be associated with a heel end point 145. The toe end point 135 may be tangential to a first vertical plane 415 (FIG. 4), and the heel end point 145 may be tangential to a second vertical plane 425 (FIG. 4). The first and second vertical planes 415 and 425, respectively, may be substantially parallel to each other and substantially perpendicular to a ground plane 200 (FIGS. 2 and 3). In one example, the first visual guide portion 122 may be located on the toe portion 130 less than one inch from the first vertical plane 415, and the second visual guide portion 124 may be located on the heel portion 140 less than one inch from the second vertical plane 425. Alternatively, the first and second visual guide portions 122 and 124, respectively, may be located at different distances from the first and second vertical planes 415 and 425, respectively. For example, the first visual guide portion 122 may be located 0.5 inch (12.7 mm) from the first vertical plane 415 whereas the second visual guide portion 124 may be located at 0.75 inch from the second vertical plane 425. The apparatus, methods, and articles of manufacture described herein are not limited in this regard.

Figure 9:
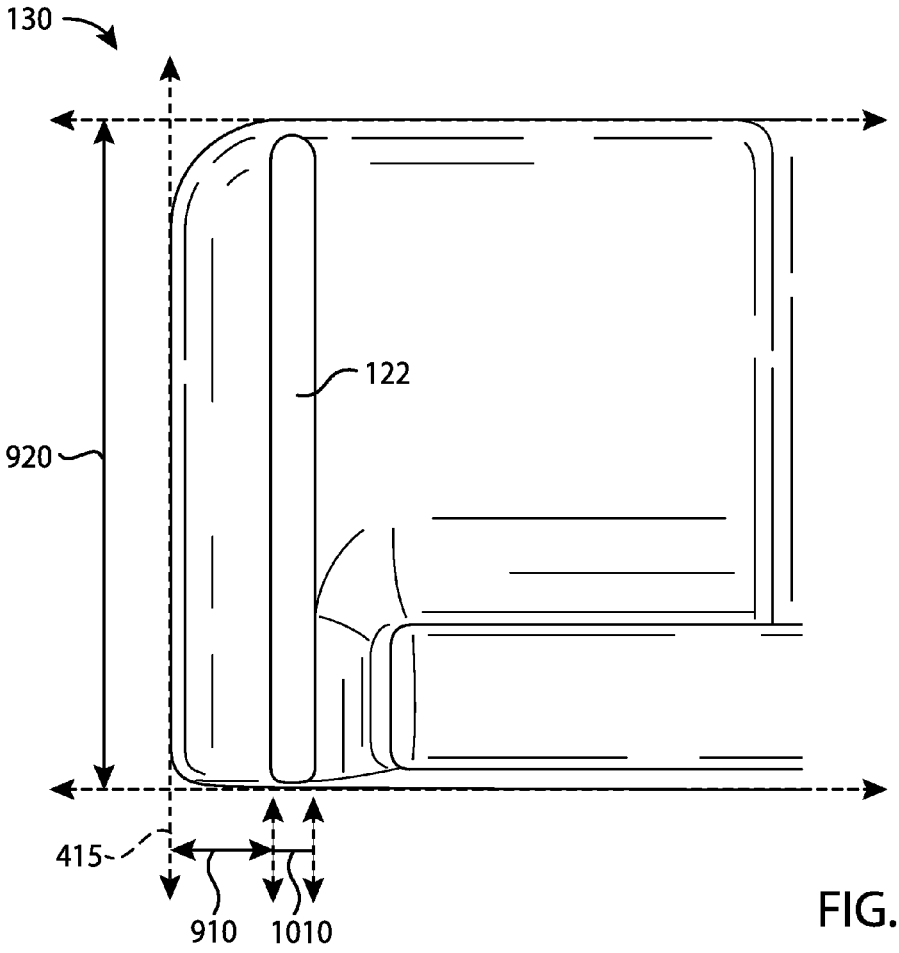
FIG. 9 depicts an exploded view of an example toe portion of the example golf club head of FIG. 1.
Figure 10:
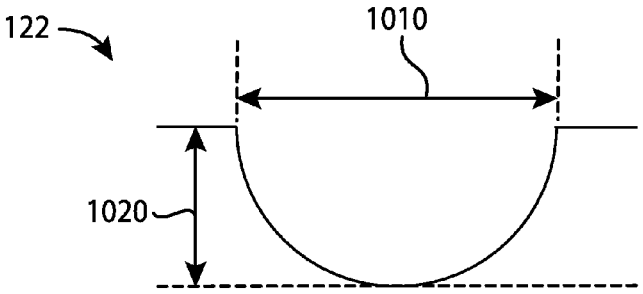
FIG. 10 depicts an exploded view of an example visual guide portion of the example golf club head of FIG. 1.

As mentioned above, the first and second visual guide portions 122 and 124, respectively, may be recessed line portions. For example, the first and second visual guide portions 122 and 124, respectively, may have a U-like cross-section shape. Alternatively, the first and second visual guide portions 122 and 124, respectively, may have a V-like cross-section shape or any other suitable cross-section shape. Turning to FIGS. 9 and 10, for example, the first visual guide portion 122 may be located a distance 910 from the first vertical plane 415. The distance 910 may be less than one inch. The first visual guide portion 122 may have a length 920 of at least 0.5 inch (12.7 mm). In particular, the length 920 may be about 1.6 inch. Further, the first visual guide portion 122 may have a width 1010 of at least 0.05 inch, and a depth 1020 of at least 0.015 inch. In one example, the width 1010 may be about 0.1 inch, and the depth 1020 may be about 0.05 inch. The apparatus, methods, and articles of manufacture described herein are not limited in this regard.

Figure 5:
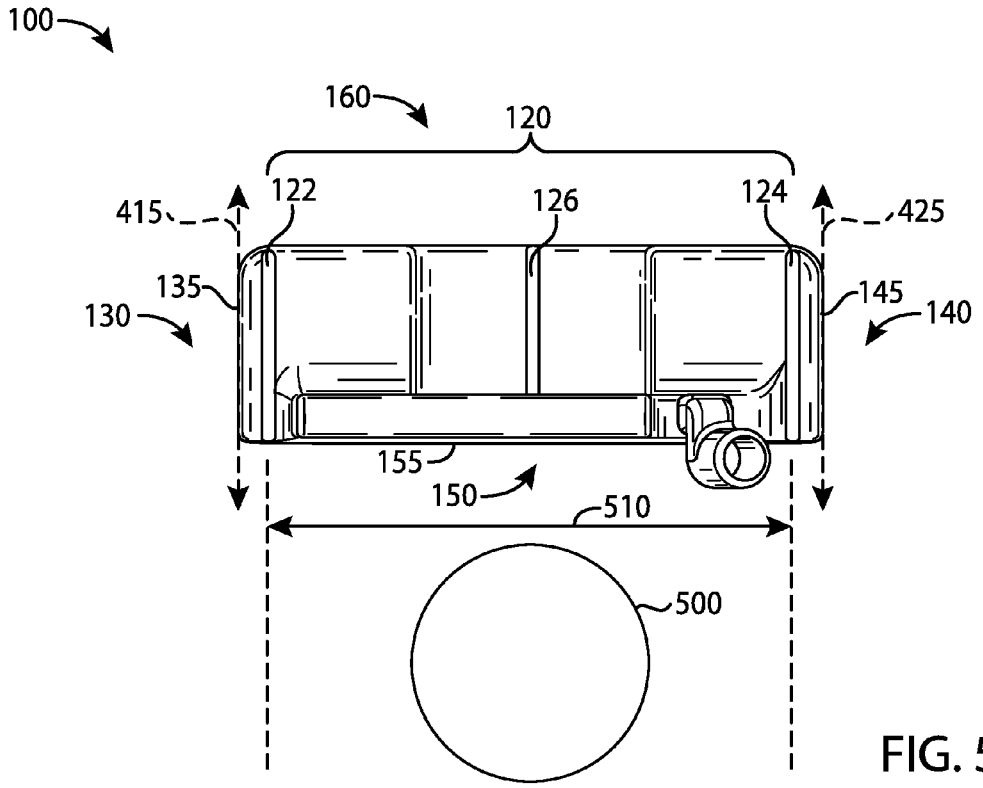
FIG. 5 depicts a top view of the example golf club head of FIG. 1.
Figure 6:
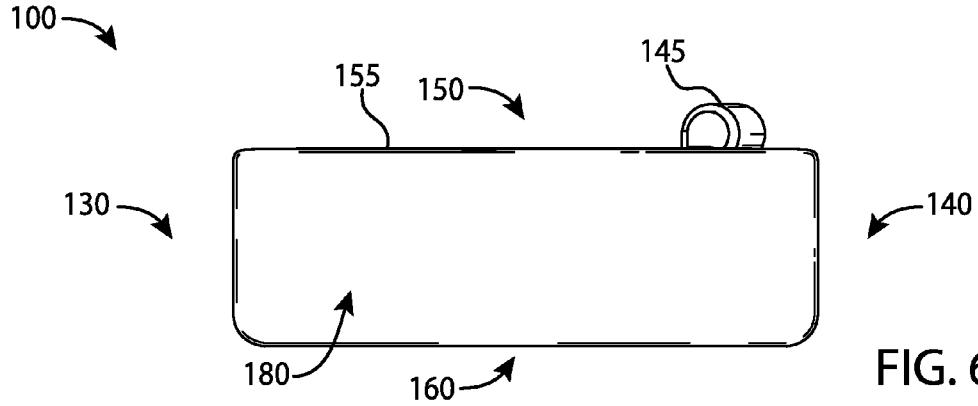
FIG. 6 depicts a bottom view of the example golf club head of FIG. 1.
Figure 7:
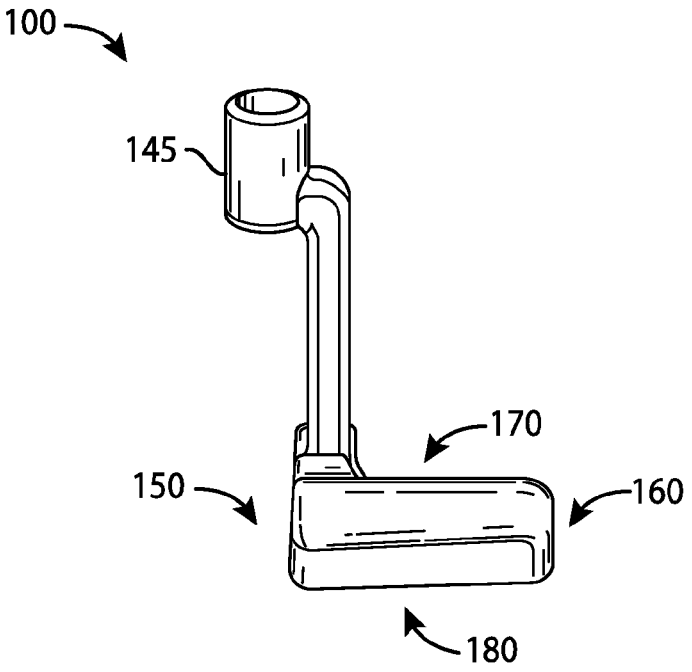
FIG. 7 depicts a left view of the example golf club head of FIG. 1.
Figure 8:
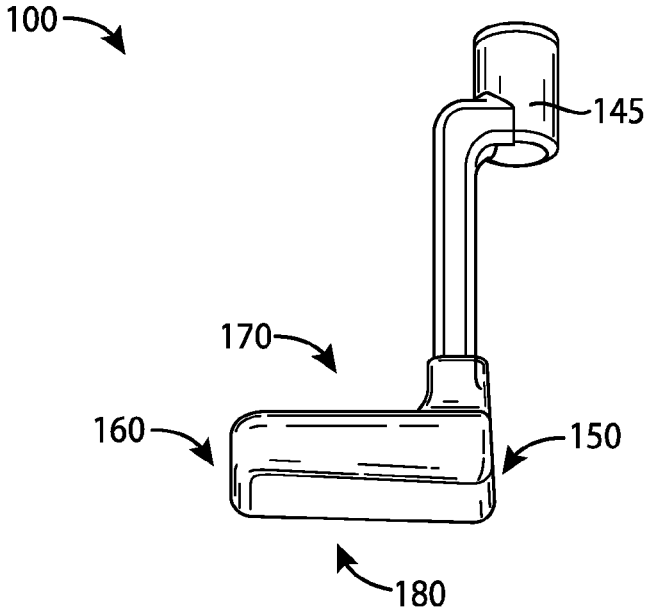
FIG. 8 depicts a right view of the example golf club head of FIG. 1.
Figure 11:
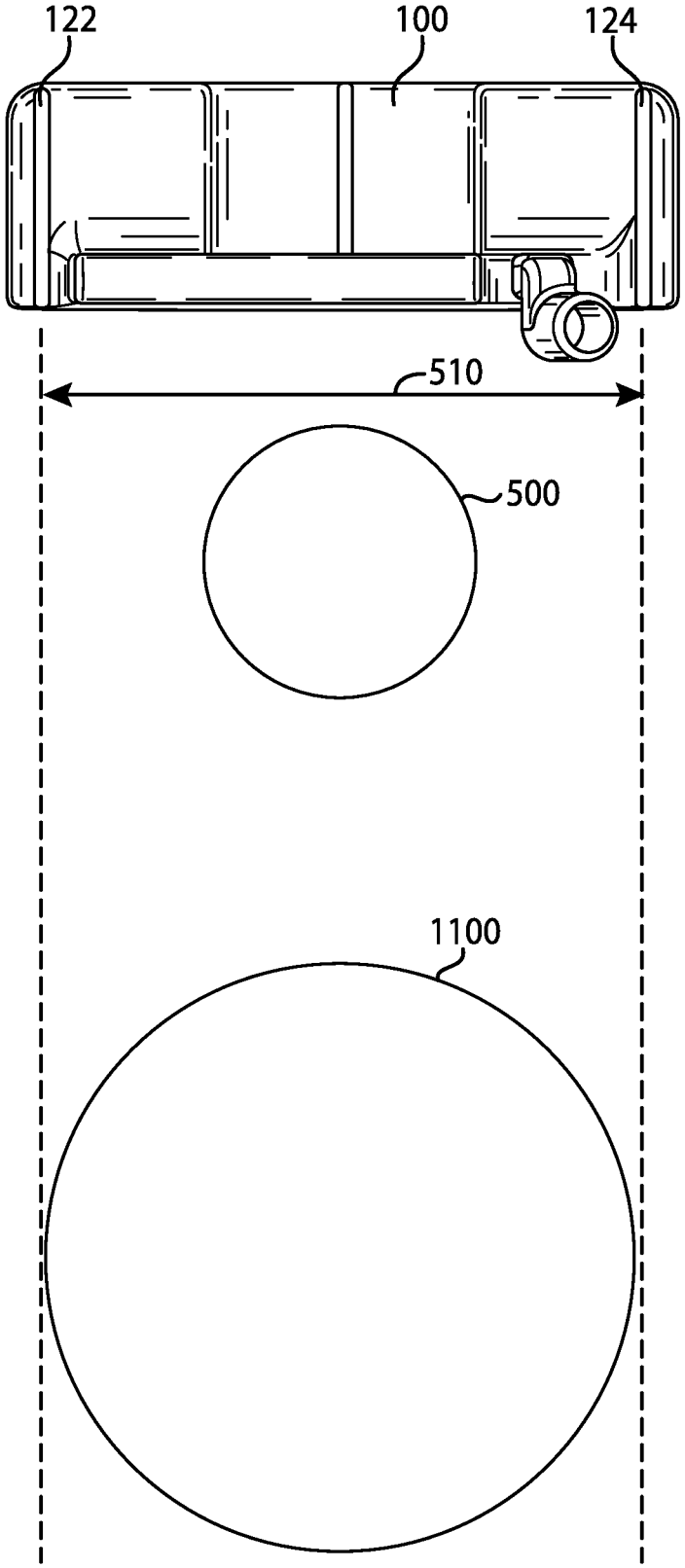
FIG. 11 depicts an example golf hole relative to the example golf club head of FIG. 1.

As with other alignment aids, the visual guide portion 120 may help with visual alignment. In contrast to other alignment aids, however, the visual guide portion 120 may help an individual to visualize a golf ball relative to a golf hole or cup. As illustrated in FIGS. 5 and 11, for example, a distance 510 may separate the first and second visual guide portions 122 and 124, respectively. The distance 510 may be parallel or substantially parallel to the face portion 155. In particular, the distance 510 may be greater than a diameter of a golf ball 500 (e.g., 1.68 inches or 42.67 millimeters). For example, the distance 510 may be greater than a diameter of a golf cup 1100 (e.g., 4.25 inches or 107.95 millimeters). By providing a mental image of the golf ball 500 being relatively smaller than the golf cup 1100 (i.e., the golf ball 500 may be less than 40% of the golf cup 1100), the first and second visual guide portions 122 and 124, respectively, may help build an individual's confidence and ability to putt. Alternatively, the distance 510 may be less than or equal to 4.25 inches but greater than 1.68 inches to provide a mental image of the golf ball 500 being relatively smaller than the golf cup 1100. The apparatus, methods, and articles of manufacture described herein are not limited in this regard.

The visual guide portion 120 may also include a third visual guide portion 126. The third visual guide portion 126 may bisect the body portion 110. The third visual guide portion 126 may define a line of symmetry for the first and second visual guide portions 122 and 124, respectively. Accordingly, the first visual guide portion 122 and the second visual guide portion 124 may be symmetrical relative to the third visual guide portion 126. In one example, the third visual guide portion 126 may be substantially equidistant from the first and second visual guide portions 122 and 124, respectively. The third guide portion 126 may be the same as or different from the first and/or second visual guide portions 122 and 124, respectively. In one example, the first, second, and third visual guide portions 122, 124, and 126, respectively, may be recessed line portions with the same color. Alternatively, the first and second visual guide portions 122 and 124, respectively, may be recessed guide portions whereas the third visual guide portion 126 may be a raised line portion. In another example, the third visual guide portion 126 may be a different color than the first and second visual guide portions 122 and 124, respectively. In yet another example, the third visual guide portion 126 may have a different length than the first and second visual guide portions 122 and 124. The apparatus, methods, and articles of manufacture described herein are not limited in this regard.

Figure 12:
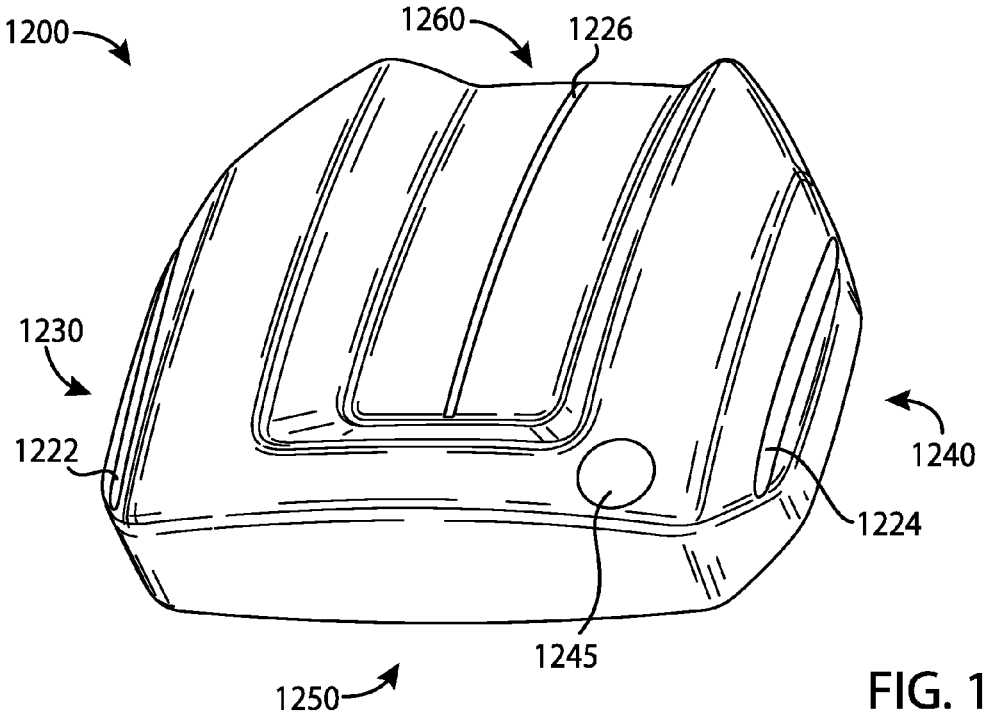
FIG. 12 depicts a front perspective view of a golf club head according to another embodiment of the apparatus, methods, and articles of manufacture described herein.
Figure 13:
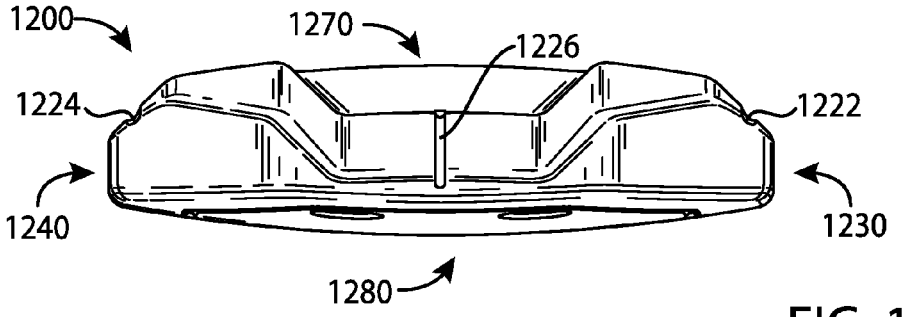
FIG. 13 depicts a rear perspective view of the example golf club head of FIG. 11.
Figure 14:
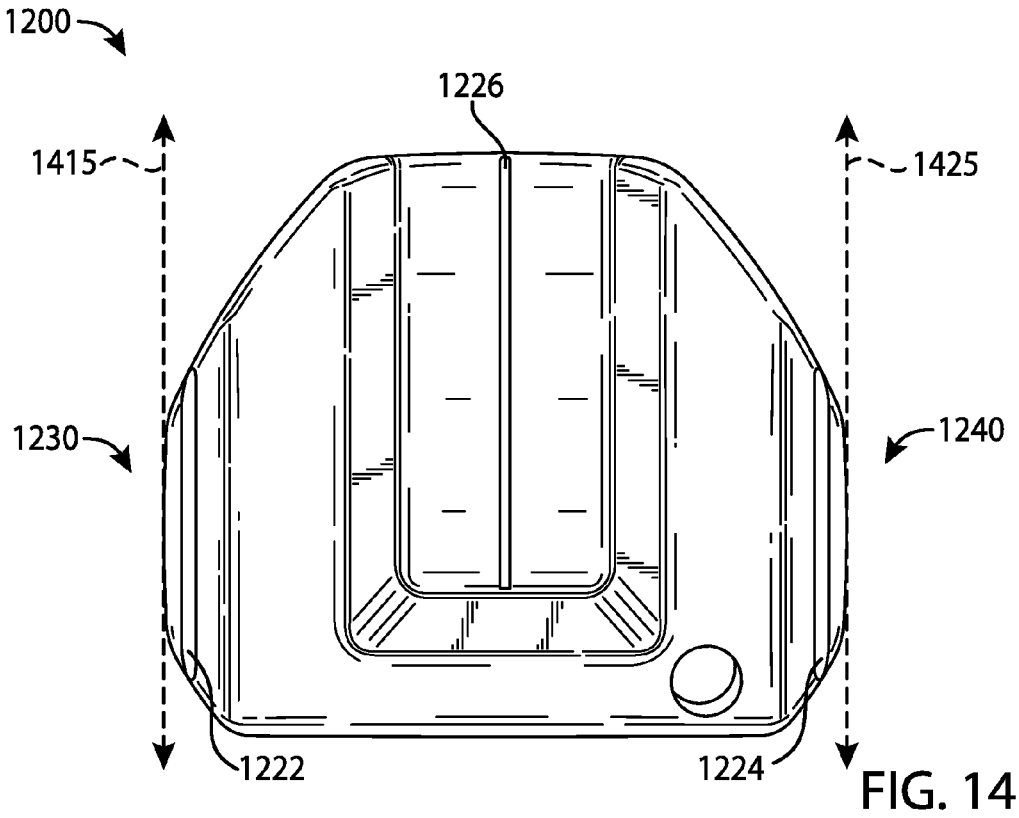
FIG. 14 depicts a top view of the example golf club head of FIG. 11.

Referring to FIGS. 12-14, for example, a golf club head 1200 may include a body portion 1210, and a visual guide portion 1220, generally shown 1222, 1224, and 1226, which are visible to an individual in an address position to assist the individual to visualize a golf ball relative to a golf hole or cup. The body portion 1210 may include a toe portion 1230, a heel portion 1240, a front portion 1250, a rear portion 1260, a top portion 1270, and a sole portion 1280. Instead of a hosel, the golf club head 1200 may include a bore 1245 to receive a shaft (not shown). In a similar manner to the visual guide portions 122 and 124 (FIGS. 1-11), the visual guide portions 1222 and 1224 may be located a particular distance from a first vertical plane 1415 and a second vertical plane 1425, respectively. For example, the visual guide portion 1222 may be located less than one inch from the first vertical plane 1415 and the visual guide portion 1224 may be located less than one inch from the second vertical plane 1425. Further, a distance may be separate the visual guide portions 1222 and 1224, which may be greater than a diameter of a golf ball. The apparatus, methods, and articles of manufacture described herein are not limited in this regard.

Figure 15:
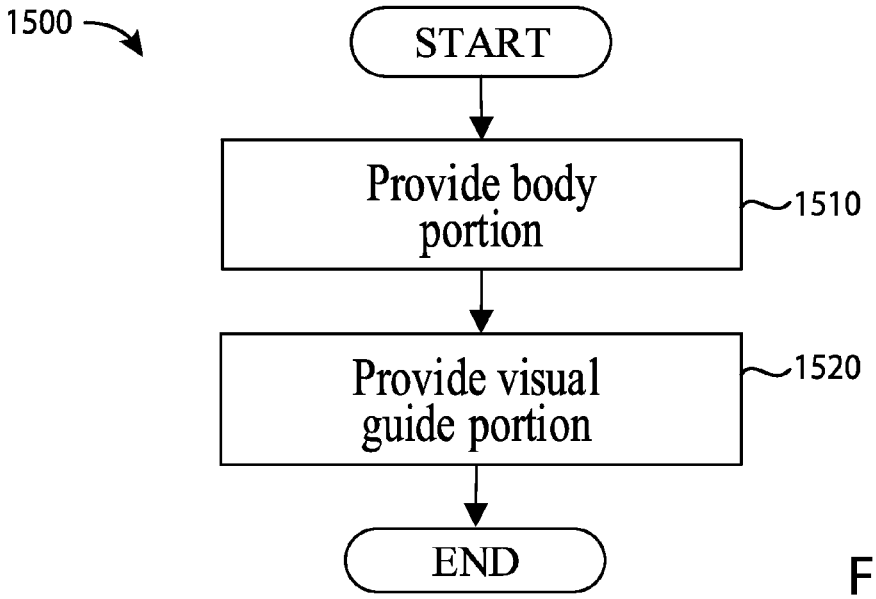
FIG. 15 depicts one manner in which the example golf club heads described herein may be manufactured.
Figure 16:
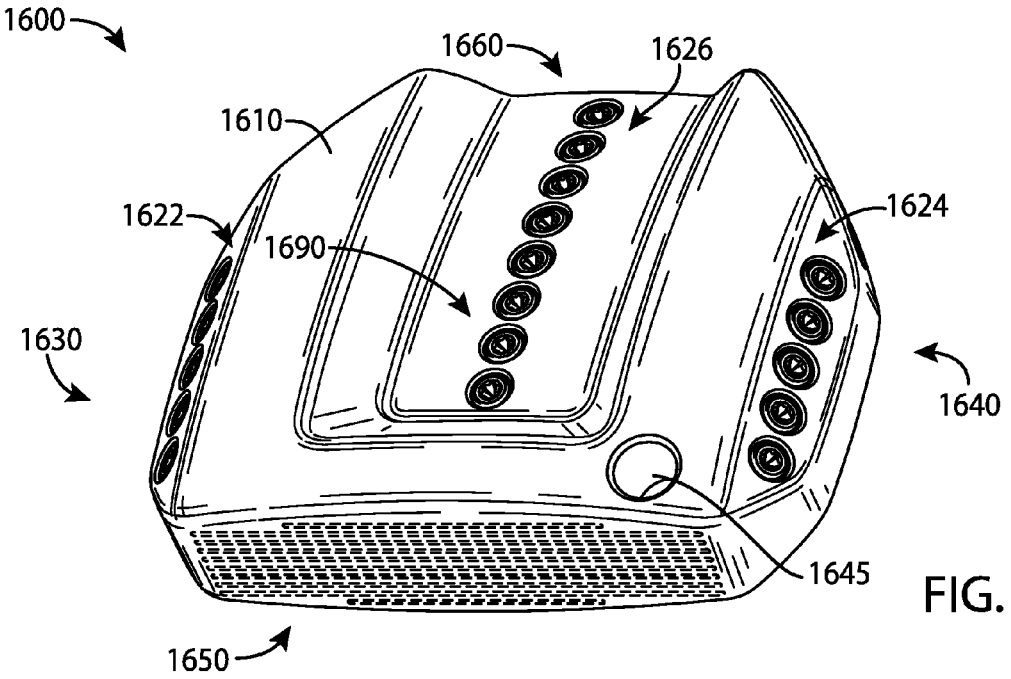
FIG. 16 depicts a front perspective view of a golf club head according to yet another embodiment of the apparatus, methods, and articles of manufacture described herein.
Figure 17:
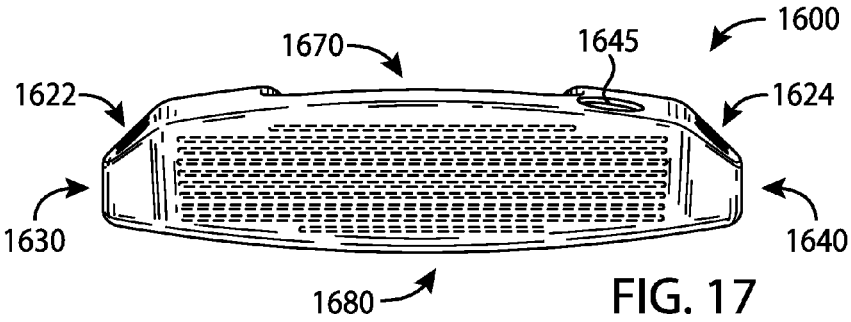
FIG. 17 depicts a front view of the example golf club head of FIG. 16.
Figure 18:
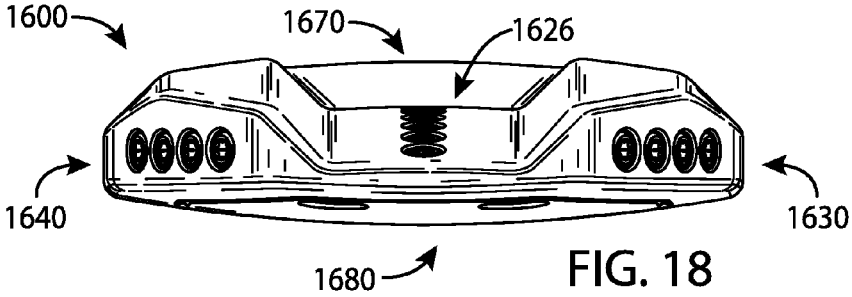
FIG. 18 depicts a rear view of the example golf club head of FIG. 16.

FIG. 15 depicts one manner in which the example golf club head described herein may be manufactured. In the example of FIG. 15, the process 1500 may begin with providing a body portion 110 having a toe portion 130, a heel portion 140, a front portion 150, and a rear portion 160 (block 1510). The front portion 150 may include a strike face 155 to strike a golf ball. The body portion 110 may be manufactured via various manufacturing methods and/or processes (e.g., a casting process, a forging process, a milling process, etc.).

To provide a visual guide to strike the golf ball with the strike face, the process 1500 may provide a visual guide portion 120 extending between the front and rear portions 150 and 160 (block 1520). The visual guide portion 120 may include a first visual guide portion 122 located at or proximate to the toe portion 130, and a second visual guide portion 124 located at or proximate to the heel portion 140. The first and second visual guide portions 122 and 124, respectively, may be substantially parallel to each other. The visual guide portion 120 may be manufactured via various manufacturing methods and/or processes (e.g., a casting process, a forging process, a milling process, etc.). For example, the visual guide portion 120 may be manufactured with the same manufacturing process as the body portion 110 (e.g., a casting process or a milling process). In another example, the visual guide portion 120 may be manufactured with a milling process whereas the body portion 110 may be manufactured with a casting process. The apparatus, methods, and articles of manufacture described herein are not limited in this regard.

Referring back to FIG. 15, the example process 1500 is merely provided and described in conjunction with other figures as an example of one way to manufacture the golf club head 100. While a particular order of actions is illustrated in FIG. 15, these actions may be performed in other temporal sequences. For example, two or more actions depicted in FIG. 15 may be performed sequentially, concurrently, or simultaneously. In one example, blocks 1510 and 1520 may be performed simultaneously or concurrently. Although FIG. 15 depicts a particular number of blocks, the process may not perform one or more blocks. The apparatus, methods, and articles of manufacture described herein are not limited in this regard.

Turning to FIGS. 16-28, for example, a golf club head 1600 may include a body portion 1610 (e.g., FIGS. 23 and 24), and a visual guide portion 1620, generally shown as 1622, 1624, and 1626. The body portion 1610 may include a toe portion 1630, a heel portion 1640, a front portion 1650, a rear portion 1660, a top portion 1670, and a sole portion 1680. The front portion 1650 may include a face portion 1655 (e.g., a strike face). The face portion 1655 may be used to impact a golf ball (one shown as 500 in FIG. 5). The body portion 1610 may also include a bore 1645 to receive a shaft (not shown). Alternatively, the body portion 1610 may include a hosel (not shown) to receive a shaft. The body portion 1610 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 1610 may be partially or entirely made of a non-metal material (e.g., composite, plastic, etc.). The apparatus, methods, and articles of manufacture described herein are not limited in this regard.

Figure 23:
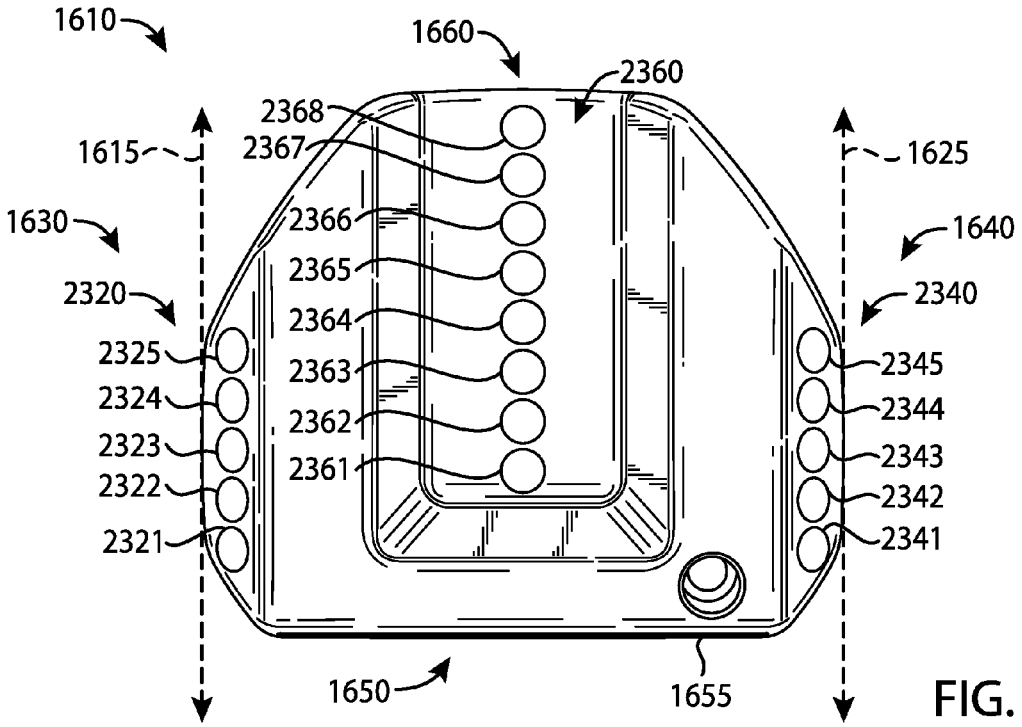
FIG. 23 depicts a top view of a body portion of the example golf club head of FIG. 16.

As illustrated in FIG. 23, for example, the body portion 1610 may include two or more weight ports, generally shown as a first set of weight ports 2320 (e.g., shown as weight ports 2321, 2322, 2323, 2324, and 2325) to form the first visual guide portion 1622 and a second set of weight ports 2340 (e.g., shown as weight ports 2341, 2342, 2343, 2344, and 2345) to form the second visual guide portion 1624. The first and second sets of weight ports 2320 and 2340, respectively, may be exterior weight ports configured to receive one or more weight portions (e.g., one shown as 2500 in FIG. 25). In particular, the first and second sets of weight ports 2320 and 2340 may be located at or proximate to a periphery of the golf club head 1600. For example, the first and second sets of weight ports 2320 and 2340, respectively, may be on or proximate to the top portion 1670. The first set of weight ports 2320 may be at or proximate to the toe portion 1630 whereas the second set of weight ports 2340 may be at or proximate to the heel portion 1640. The first visual guide portion 1622 may be located at or proximate to the toe portion 1630 between the face portion 1655 and the periphery of the golf club head 1600 (e.g., shown in FIG. 23). The second guide portion 1624 may be located at or proximate to the heel portion 1640 between the face portion 1655 and the periphery of the golf club head 1600 (e.g., shown in FIG. 23). Thus, the face portion 1655 may extend between the first visual guide portion 1622 and the second visual guide portion 1624.

Each weight port of the first set of weight ports 2320 may have a first port diameter ($PD_1$). In particular, a uniform distance of less than the first port diameter may separate any two adjacent weight ports of the first set 2320 (e.g., (i) weight ports 2321 and 2322, (ii) weight ports 2322 and 2323, (iii) weight ports 2323 and 2324, or (iv) weight ports 2324 and 2325). In one example, the first port diameter may be about 0.25 inch and any two adjacent weight ports of the first set 2320 may be separated by 0.1 inch. In a similar manner, each weight port of the second set of weight ports 2340 may have a second diameter ($PD_2$). A uniform distance of less than the second port diameter may separate any two adjacent weight ports of the second set 2340 (e.g., (i) weight ports 2341 and 2342, (ii) weight ports 2342 and 2343, (iii) weight ports 2343 and 2344, or (iv) weight ports 2344 and 2345). The first and second port diameters may be equal to each other (i.e., $PD_1=PD_2$). For example, a the second port diameter may be about 0.25 inch and any two adjacent weight ports of the second set 2340 may be separated by 0.1 inch. The apparatus, methods, and articles of manufacture described herein are not limited in this regard.

As noted above, the visual guide portion 1620 may include a third guide portion 1626. Accordingly, the body portion 1610 may include two or more weight ports, generally shown as a third set of weight ports 2360 (e.g., shown as weight ports 2361, 2362, 2363, 2364, 2365, 2366, 2367, and 2368) to form the third visual guide portion 1626. In particular, the third visual guide portion 1626 may be substantially equidistant from the first and second visual guide portions 1622 and 1624. For example, the third visual guide portion 1626 may extend between the front and rear portions 1650 and 1660 located at or proximate to a center of the body portion 1610. Thus, the third visual guide portion 1626 may define a line of symmetry for the first and second visual guide portions 1622 and 1624, respectively. Accordingly, the first visual guide portion 1622 and/or the second visual guide portion 1624 may be symmetrical to the third visual guide portion 1626. The apparatus, methods, and articles of manufacture described herein are not limited in this regard.

Each weight port of the third set of weight ports 2360 may have a third port diameter ($PD_3$). The third port diameter may be equal to the first port diameter or the second port diameter (e.g., $PD_1=PD_2=PD_3$). In particular, a uniform distance of less than the third port diameter may separate any two adjacent weight ports of the third set 2360 (e.g., (i) weight ports 2361 and 2362, (ii) weight ports 2362 and 2363, (iii) weight ports 2363 and 2364, (iv) weight ports 2364 and 2365, (v) weight ports 2365 and 2366, (vi) weight ports 2366 and 2367, or (vii) weight ports 2367 and 2368). The body portion 1610 may also include a U-shape recess portion 1690. The third visual guide portion 1626 may be located in the U-shape recess portion 1690. The apparatus, methods, and articles of manufacture described herein are not limited in this regard.

Figure 24:
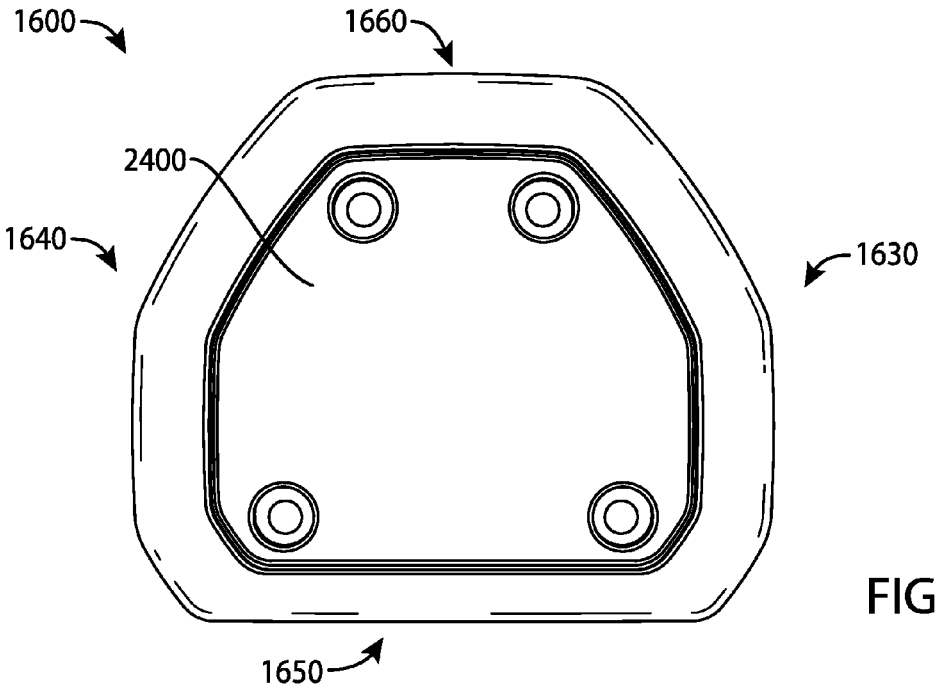
FIG. 24 depicts a bottom view of the example body portion of FIG. 23.

Further as shown in FIG. 24, the body portion 1610 may include an interior cavity 2400. The interior cavity 2400 may be partially or entirely filled with an elastic polymer or elastomer material, a thermoplastic elastomer material (TPE), a thermoplastic polyurethane material (TPU), and/or other suitable types of materials to absorb shock, isolate vibration, and/or dampen noise. A plate portion 2000 (FIG. 20) may cover the interior cavity 2400 from the sole portion 1680. The plate portion 2000 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 1610 may be partially or entirely made of a non-metal material (e.g., composite, plastic, etc.) with one shown as 2810 in FIG. 28.

In a similar manner to the visual guide portions 1222 and 1224 (FIGS. 12-14), the visual guide portions 1622 and 1624, respectively, may be located a particular distance from a first vertical plane 1615 and a second vertical plane 1625, respectively. For example, the visual guide portion 1622 may be located less than one inch from the first vertical plane 1615 and the visual guide portion 1624 may be located less than one inch from the second vertical plane 1625. Further, a distance 1910 may separate the visual guide portions 1622 and 1624, which may be greater than a diameter of a golf ball. In one example, the distance 1910 may be greater than three inches (3 in.). In another example, the distance 1910 may be about 3.75 inches. The distance 1910 may be parallel or substantially parallel to the face portion 1655.

The visual guide portions 1622 and 1624 may be located relative to the periphery of the golf club head 1600. In one example, the visual guide portion 1622 may be located less than 0.5 inch (12.7 mm) from the periphery at or proximate to the toe portion 1630 whereas the visual guide portion 1624 may be located less than 0.5 inch (12.7 mm) from the periphery at or proximate to the heel portion 1640. Further, each of the visual guide portions 1622 and 1624 may extend about a maximum length 1690 between the front and rear portions 1650 and 1660. Alternatively, each of the visual guide portions 1622 and 1624 may extend less than 50% of the maximum length 1690 between the front and rear portions 1650 and 1660. The apparatus, methods, and articles of manufacture described herein are not limited in this regard.

Instead of a solid line (e.g., the visual guide portions 1222 and 1224), each of the visual guide portions 1622 and 1624, respectively, may be dotted lines formed by two or more weight portions, generally shown as a first set of weight portions 1920 (e.g., shown as 1921, 1922, 1923, 1924, and 1925) and a second set of weight portions 1940 (e.g., shown as 1941, 1942, 1943, 1944, and 1945). In a similar manner, the visual guide portion 1626 may be a dotted line formed by two or more weight portions, generally shown as the third set of weight portions 1960 (e.g., shown as 1961, 1962, 1963, 1964, 1965, 1966, 1967, and 1968). The first, second, and third sets of weight portions 1920, 1940, and 1960, respectively, may be partially or entirely made of a high-density material such as a tungsten-based material or suitable types of materials. Alternatively, the first, second, and third sets of weight portions 1920, 1940, and 1960, respectively, may be partially or entirely made of a non-metal material (e.g., composite, plastic, etc.). The apparatus, methods, and articles of manufacture described herein are not limited in this regard.

Figure 25:
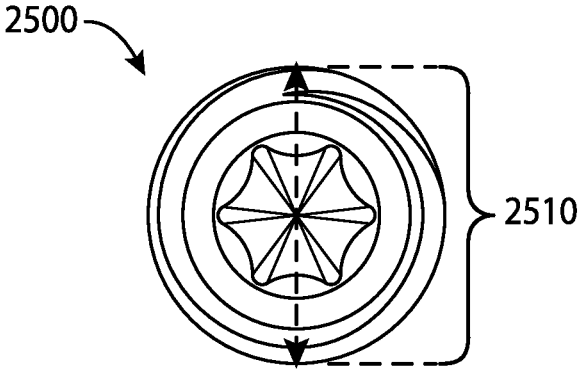
FIG. 25 depicts a top view of a weight portion associated with the example golf club head of FIG. 16.
Figure 26:
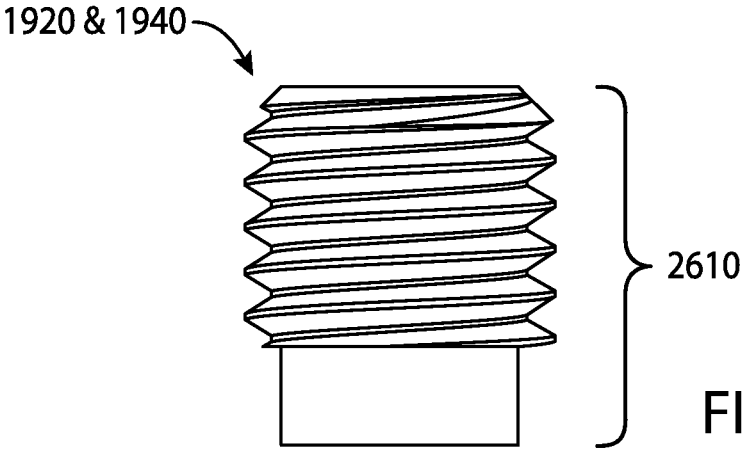
FIG. 26 depicts a side view of a weight portion associated with the example golf club head of FIG. 16.
Figure 27:
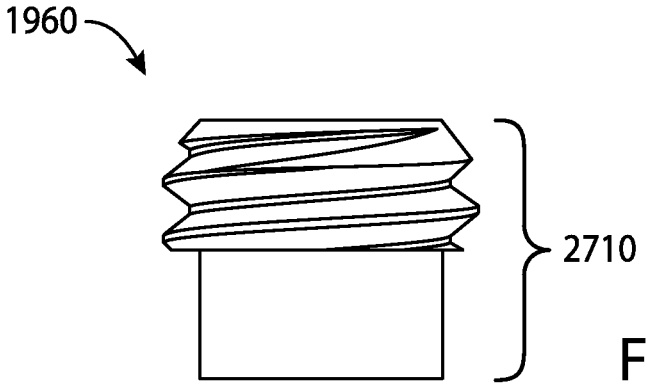
FIG. 27 depicts a side view of another weight portion associated with the example golf club head of FIG. 16.
Figure 28:
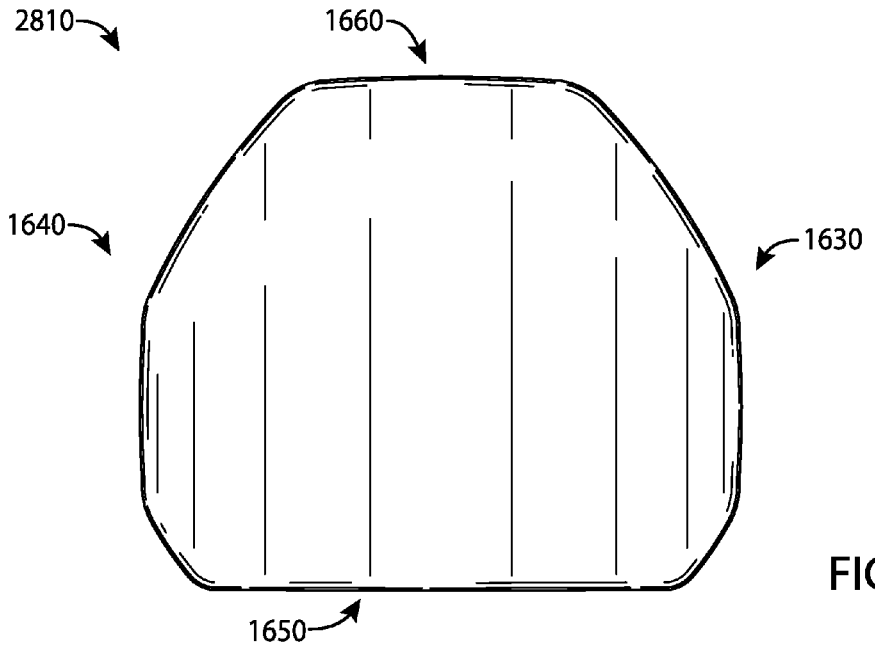
FIG. 28 depicts a bottom view of another example body portion of FIG. 16.

The first, second, and third sets of weight portions 1920, 1940, and 1960, respectively, may have similar or different physical properties (e.g., density, shape, mass, volume, size, color, etc.). In the illustrated example as shown in FIGS. 25-27, each of the weight portions of the first, second, and third sets 1920, 1940, and 1960 may have a cylindrical shape (e.g., a circular cross section). Alternatively, each of the weight portions of the first and second sets 1920 and 1940 may have a first shape (e.g., a cylindrical shape) whereas each of the weight portions of the third set 1960 may have a second shape (e.g., a rectangular shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

Further, each of the weight portions of the first, second, and third sets 1920, 1940, and 1960, respectively, may have a diameter 2510 of about 0.25 inch but the first, second, and third sets of weight portions 1920, 1940, and 1960, respectively, may be different in height. In particular, each of the weight portions of the first and second sets 1920 and 1940 may be associated with a first height 2610 (FIG. 26), and each of the weight portion of the third set 1960 may be associated with a second height 2710 (FIG. 27). The first height 2610 may be relatively longer than the second height 2710. In one example, the first height 2610 may be about 0.3 inch whereas the second height 2710 may be about 0.16 inch. Alternatively, the first height 2610 may be equal to or less than the second height 2710. The apparatus, methods, and articles of manufacture described herein are not limited in this regard.

The first and second sets of weight portions 1920 and 1940, respectively, may include threads to secure in the weight ports. For example, each weight portion of the first and second sets of weight portions 1920 and 1940 may be a screw. The first and second sets of weight portions 1920 and 1940, respectively, may not be readily removable from the body portion 1610 with or without a tool. Alternatively, the first and second sets of weight portions 1920 and 1940, respectively, may be readily removable (e.g., with a tool) so that a relatively heavier or lighter weight portion may replace one or more of the weight portions of the first and second sets 1920 and 1940, respectively. In another example, the first and second sets of weight portions 1920 and 1940, respectively, may be secured in the weight ports of the body portion 1610 with epoxy or adhesive so that the first and second sets of weight portions 1920 and 1940, respectively, may not be readily removable. In yet another example, the first and second sets of weight portions 1920 and 1940, respectively, may be secured in the weight ports of the body portion 1610 with both epoxy and threads so that the first and second sets of weight portions 1920 and 1940, respectively, may not be readily removable. The apparatus, methods, and articles of manufacture described herein are not limited in this regard.

The golf club head 1600 may also include a fourth set of weight portions 2120 (e.g., shown as 2121, 2122, 2123, and 2124) and a fifth set of weight portions 2220 (e.g., shown as 2221, 2222, 2223, and 2224). Although both the fourth and fifth sets of weight portions 2120 and 2220 may be located at or proximate to the rear portion 1660, the fourth set of weight portions 2120 may be located at or proximate to the heel portion 1640 whereas the fifth set of weight portions 2220 may be at or proximate to the toe portion 1630. Each of the fourth and fifth sets of weight portions 2120 and 2220 may include at least three weight portions. The third visual guide portion 1626 may define a line of symmetry for the fourth and fifth set of weight portions 2120 and 2220, respectively. Accordingly, the fourth set of weight portions 2120 and/or the fifth set of weight portions 2220 may be symmetrical relative to the third visual guide portion 1626. The fourth set of weight portions 2120 may be located proximate to the toe portion 1630 and the rear portion 1660 between the face portion 1655 and the periphery of the golf club head 1600 (e.g., shown in FIGS. 22 and 23). The fifth set of weight portions 2220 may be located proximate to the heel portion 1640 and the rear portion 1660 between the face portion 1655 and the periphery of the golf club head 1600 (e.g., shown in FIGS. 22 and 23). Thus, the face portion 1655 may extend between the fourth set of weight portions 2120 and the fifth set of weight portions 2220. The apparatus, methods, and articles of manufacture described herein are not limited in this regard.

Figure 19:
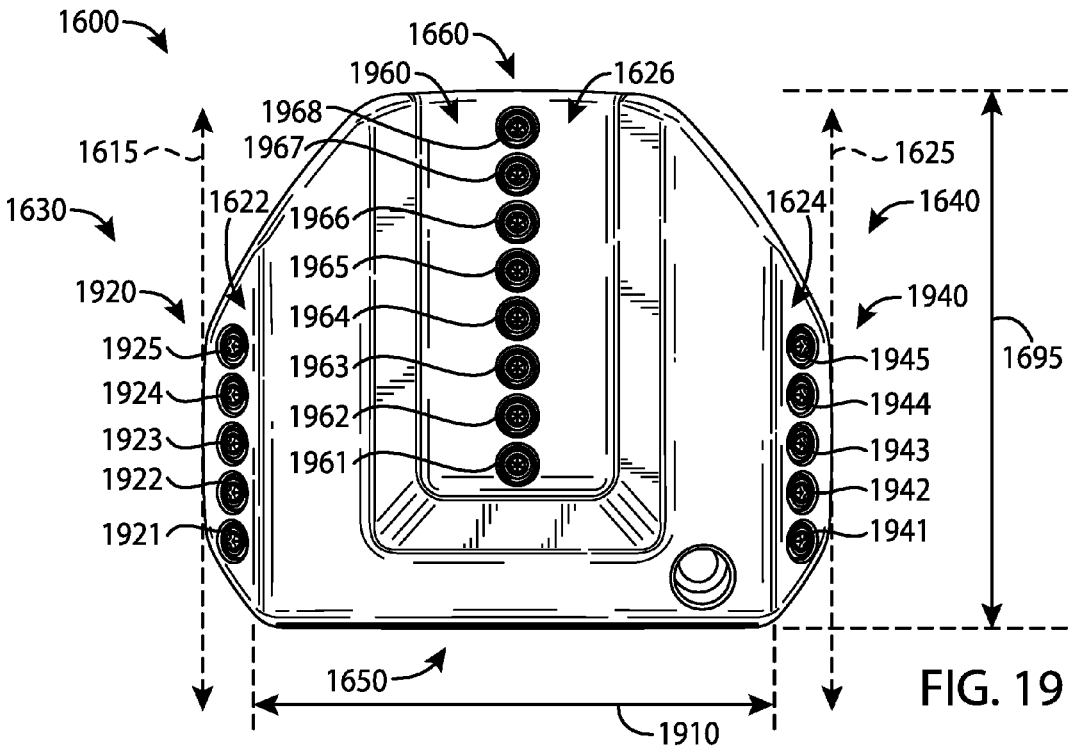
FIG. 19 depicts a top view of the example golf club head of FIG. 16.
Figure 20:
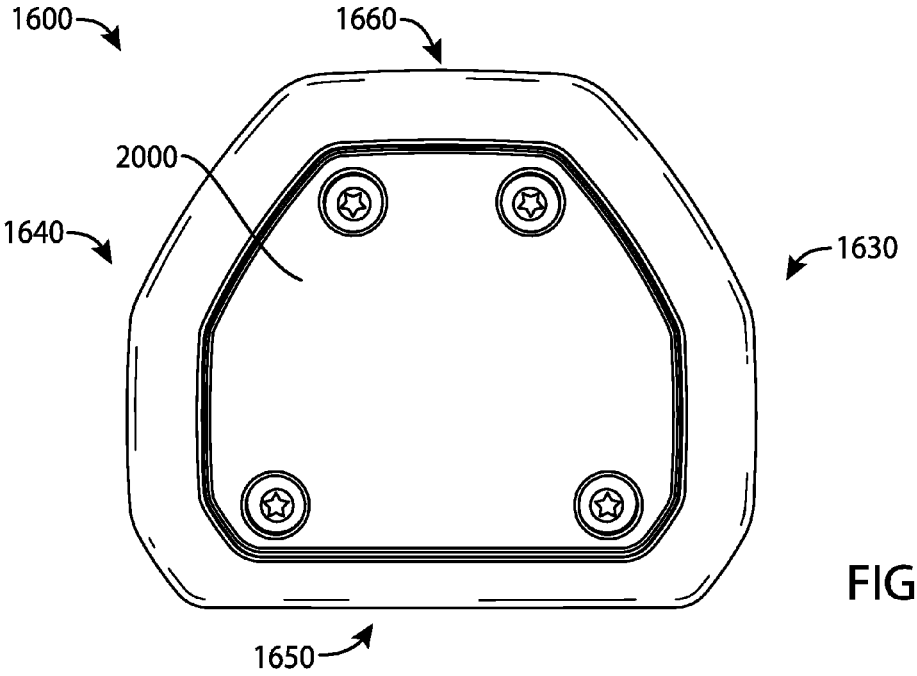
FIG. 20 depicts a bottom view of the example golf club head of FIG. 16.
Figure 21:
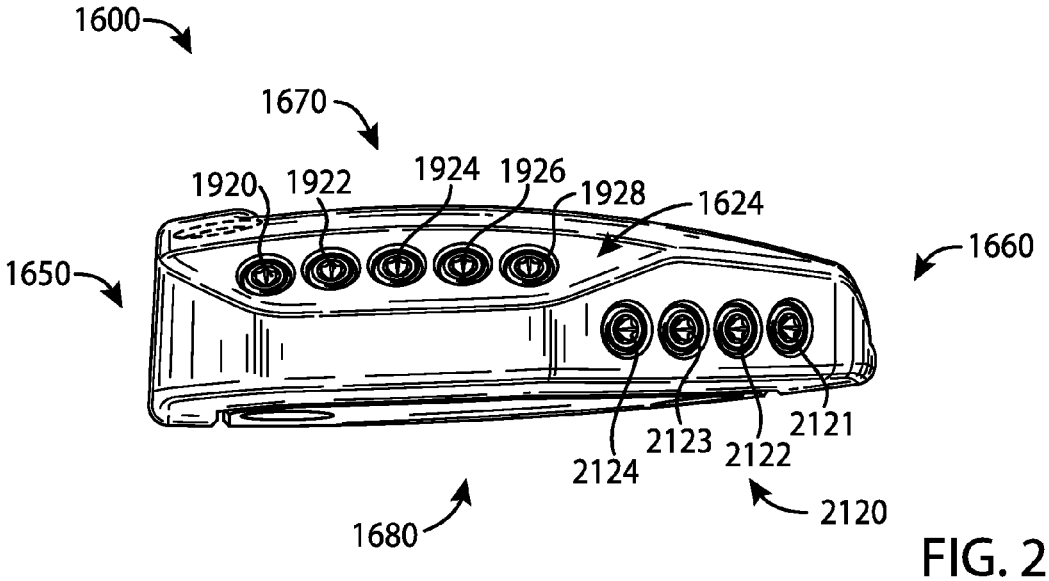
FIG. 21 depicts a left view of the example golf club head of FIG. 16.
Figure 22:
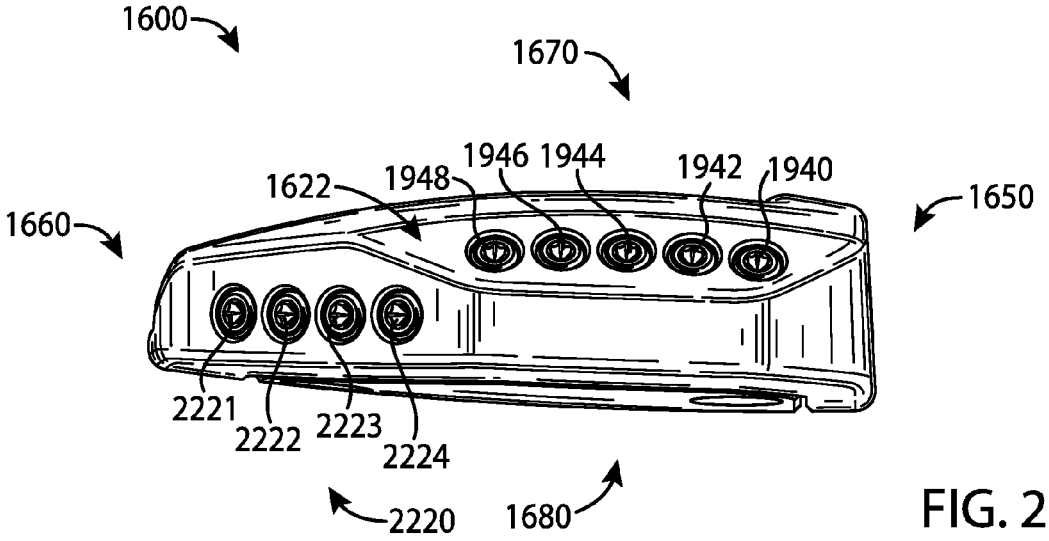
FIG. 22 depicts a right view of the example golf club head of FIG. 16.

The visual guide portions 1622 and 1624, which may be defined as described herein by the first set of weight portions 1920 and the second set of weight portions 1940, respectively, may follow the contour of the periphery of the golf club head 1600. In the example of FIG. 19, the first set of weight portions 1920 follow the contour of the periphery of the golf club head 1600 at or proximate to the toe portion 1630, and the second set of weight portions 1940 follow the contour of the periphery of the golf club head 1600 at or proximate to the heel portion 1640. The fourth set of weight portions 2120 and the fifth set of weight portions 2220 may follow the contour of the periphery of the golf club head 1600. In the example of FIGS. 21 and 22, the fourth set of weight portions 2120 follow the contour of the periphery of the golf club head 1600 proximate to the toe portion 1630, and the fifth set of weight portions 2220 follow the contour of the periphery of the golf club head 1600 proximate to the heel portion 1640. The first set of weight portions 1920 and the fourth set of weight portions 2120 may collectively follow the contour of the periphery of the golf club head 1600 at or proximate to the toe portion 1630 between the front portion 1650 and the rear portion 1660. The second set of weight portions 1940 and the fifth set of weight portions 2220 may collectively follow the contour of the periphery of the golf club head 1600 at or proximate to the heel portion 1640 between the front portion 1650 and the rear portion 1660. The apparatus, methods, and articles of manufacture described herein are not limited in this regard.

Figure 29:
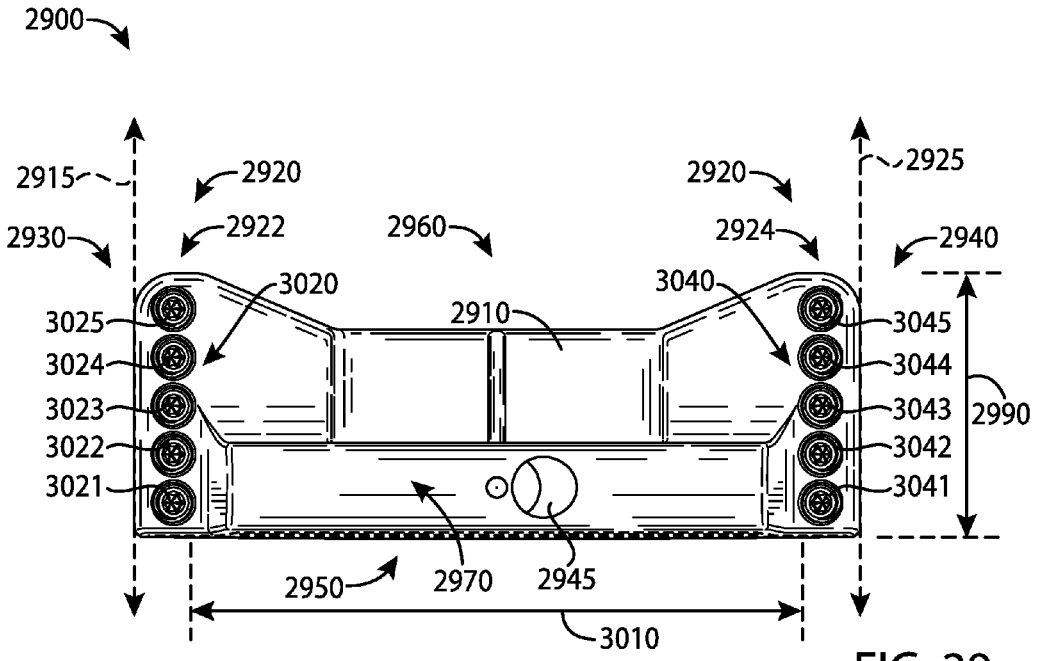
FIG. 29 depicts a top view of a golf club head according to yet another embodiment of the apparatus, methods, and articles of manufacture described herein.

Although the above examples may describe a particular number of visual guide portions, weight ports, and weight portions, the apparatus, methods, and articles of manufacture described herein may include more or less visual guide portions, weight ports, and/or weight portions. While FIGS. 16-24 may depict a particular type of putter club head (e.g., a mallet-type putter club head), the apparatus, methods, and articles of manufacture described herein may be applicable to other types of putters. As illustrated in FIG. 29, the apparatus, methods, and articles of manufacture described herein may be applicable to a blade-type putter club head 2900. For example, the golf club head 2900 may include a body portion 2910, and a visual guide portion 2920, generally shown as 2922, and 2924. The body portion 2910 may include a toe portion 2930, a heel portion 2940, a front portion 2950, a rear portion 2960, and a top portion 2970. The body portion 2910 may also include a bore 2945 to receive a shaft (not shown). Alternatively, the body portion 2910 may include a hosel (not shown) to receive a shaft. The body portion 2910 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the body portion 2910 may be partially or entirely made of a non-metal material (e.g., composite, plastic, etc.). The apparatus, methods, and articles of manufacture described herein are not limited in this regard.

In a similar manner to the visual guide portions 1622 and 1624 (FIGS. 16-24), the visual guide portions 2922 and 2924, respectively, may be located a particular distance from a first vertical plane 2915 and a second vertical plane 2925, respectively. For example, the visual guide portion 2922 may be located less than one inch from the first vertical plane 2915 and the visual guide portion 2924 may be located less than one inch from the second vertical plane 2925. Further, a distance 3010 may separate the visual guide portions 2922 and 2924, which may be greater than a diameter of a golf ball. In one example, the distance 3010 may be greater than three inches (3 in.). In another example, the distance 3010 may be about 3.75 inches.

The visual guide portions 2922 and 2924 may be located relative to the periphery of the golf club head 2900. In one example, the visual guide portion 2922 may be located less than 0.5 inch (12.7 mm) from the periphery at or proximate to the toe portion 2930 whereas the visual guide portion 2924 may be located less than 0.5 inch (12.7 mm) from the periphery at or proximate to the heel portion 2940. Further, each of the visual guide portions 2922 and 2924 may extend about a maximum length 2990 between the front and rear portions 2950 and 2960. Alternatively, each of the visual guide portions 2922 and 2924 may extend less than 50% of the maximum length 2990 between the front and rear portions 2950 and 2960. The apparatus, methods, and articles of manufacture described herein are not limited in this regard.

Each of the visual guide portions 2922 and 2924, respectively, may be dotted lines formed by two or more weight portions, generally shown as a first set of weight portions 3020 (e.g., shown as 3021, 3022, 3023, 3024, and 3025) and a second set of weight portions 3040 (e.g., shown as 3041, 3042, 3043, 3044, and 3045). The first and second sets of weight portions 3020 and 3040, respectively, may be partially or entirely made of a high-density material such as a tungsten-based material or suitable types of materials. Alternatively, the first and second sets of weight portions 3020 and 3040, respectively, may be partially or entirely made of a non-metal material (e.g., composite, plastic, etc.). The apparatus, methods, and articles of manufacture described herein are not limited in this regard.

The first and second sets of weight portions 3020 and 3040, respectively, may have similar or different physical properties (e.g., density, shape, mass, volume, size, color, etc.). In the illustrated example as shown in FIGS. 25-27, each of the weight portions of the first and second sets 3020 and 3040 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape).

The first and second sets of weight portions 3020 and 3040, respectively, may include threads to secure in the weight ports, which may also have corresponding threads. For example, each weight portion of the first and second sets of weight portions 3020 and 3040 may be a screw. The first and second sets of weight portions 3020 and 3040, respectively, may not be readily removable from the body portion 2910 with or without a tool. Alternatively, the first and second sets of weight portions 3020 and 3040, respectively, may be readily removable (e.g., with a tool) so that a relatively heavier or lighter weight portion may replace one or more of the weight portions of the first and second sets 3020 and 3040, respectively. In another example, the first and second sets of weight portions 3020 and 3040, respectively, may be secured in the weight ports of the body portion 2010 with epoxy or adhesive so that the first and second sets of weight portions 3020 and 3040, respectively, may not be readily removable. In yet another example, the first and second sets of weight portions 3020 and 3040, respectively, may be secured in the weight ports of the body portion 2910 with both epoxy and threads so that the first and second sets of weight portions 3020 and 3040, respectively, may not be readily removable. The apparatus, methods, and articles of manufacture described herein are not limited in this regard.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a toe portion, a heel portion, a rear portion, a front portion with a face portion, a sole portion, and a top portion with a plurality of weight ports, the body portion defining a periphery of the golf club head;

a plurality of weight ports comprising a first set of weight ports and a second set of weight ports, the first set of weight ports being in the body portion located at or proximate to the periphery and the toe portion, the first set of weight ports comprising at least two weight ports extending between the rear portion and the front portion, the at least two weight ports of the first set of weight ports being separated by a first port distance less than the port diameter of any of the at least two weight ports of the first set of weight ports, the second set of weight ports being in the body portion located at or proximate to the periphery and the heel portion, the second set of weight ports comprising at least two weight ports extending between the rear portion and the front portion, the at least two weight ports of the second set of weight ports being separated by a second port distance less than the port diameter of any of the at least two weight ports of the second set of weight ports;

a plurality of weight portions with each weight portion disposed in one weight port of the plurality of weight ports;

a recess portion located on the to portion, the recess portion having a third set of weight ports comprising at least two weight ports extending between the front and rear portions and located substantially equidistant from the first and second set of weight ports; and wherein a distance between the first set of weight ports and the second set of weight ports in a direction substantially parallel to the face portion is less than or equal to a diameter of a golf cup and greater than a diameter of a golf ball.

2. A golf club head as defined in claim 1, wherein the first port distance comprises a distance less than 50% of the port diameter of any of the at least two weight ports of the first set of weight ports, and wherein the second port distance comprises a distance less than 50% of the port diameter of any of the at least two weight ports of the second set of weight ports.

3. A golf club head as defined in claim 1, wherein each of the first and second weight ports comprises a length less than 50% of a maximum length between the front and rear portions.

4. A golf club head as defined in claim 1, wherein each of the first and second weight ports comprises a length greater than 50% of a maximum length between the front and rear portions.

5. A golf club head as defined in claim 1, wherein the first set of weight ports is located less than 0.5 inch (12.7 mm) from the periphery at or proximate to the toe portion, and the second set of weight ports is located less than 0.5 inch (12.7 mm) from the periphery at or proximate to the heel portion.

6. A golf club head as defined in claim 1, wherein at least a portion of each of the first and second sets of weight ports are visible to an individual in an address position and define visual guide portions.

7. A golf club head as defined in claim 1, wherein at least a portion of the plurality of weight ports extends between the rear portion and the front portion substantially similar to a contour of the periphery at or proximate to the toe portion, and wherein at least another portion of the plurality of weight ports extends between the rear portion and the front portion substantially similar to a contour of the periphery at or proximate to the heel portion.

8. A golf club head comprising:

a body portion having a toe portion, a heel portion, a rear portion, a front portion with a strike face, a top portion, and a sole portion;

a plurality of weight ports comprising a first set of weight ports and a second set of weight ports, the first set of weight ports being in the body portion on a toe side of body portion, the first set of weight ports comprising a plurality of weight ports extending between the rear portion and the front portion, at least two weight ports of the first set of weight ports being separated by a first port distance less than the port diameter of any of the at least two weight ports of the first set of weight ports, the second set of weight ports being in the body portion on a heel side of the body portion, the second set of weight ports comprising a plurality of weight ports extending between the rear portion and the front portion, at least two weight ports of the second set of weight ports being separated by a second port distance less than the port diameter of any of the at least two weight ports of the second set of weight ports; and a visual guide portion located in a recess portion on the top portion and extending between the front and rear portions to provide a visual guide to strike a golf ball with the strike face, the visual guide portion comprising at least two weight ports extending between the front and rear portions and located substantially equidistant from the first and second set of weight ports;

a plurality of weight portions with each weight portion disposed in one weight port of the plurality of weight ports; and wherein the first set of weight ports and the second set of weight ports are substantially symmetrical relative to the visual guide portion.

9. A golf club head as defined in claim 8, wherein the visual guide portion comprises at least one of a colored line portion, a raised line portion, a recessed line portion, a laser-etched line portion, or a third set of weight ports.

10. A golf club head as defined in claim 8, wherein the visual guide portion comprises a length of at least 0.5 inch (12.7 mm).

11. A golf club head as defined in claim 8, wherein the first set of weight ports and second set of weight ports are separated by a distance greater than 1.68 inches (42.67 mm) and less than or equal to 4.25 inches (107.95 mm).

12. A golf club head as defined in claim 8, wherein the first set of weight ports and the second set of weight ports comprise a pair of substantially congruent visual guide portions.

13. A golf club head as defined in claim 8, wherein the first set of weight ports and the second set of weight ports are substantially parallel with the visual guide portion.

14. A golf club head as defined in claim 8 further comprising an internal cavity partially or entirely filled with an elastic polymer material.

15. A golf club head as defined in claim 8, further comprising the body portion defining a periphery of the golf club head, wherein at least a portion of the plurality of weight ports extends between the rear portion and the front portion substantially similar to a contour of the periphery proximate to the toe portion, and wherein at least another portion of the plurality of weight ports extends between the rear portion and the front portion substantially similar to a contour of the periphery proximate to the heel portion.

16. A putter-type golf club head comprising:

a body portion having a toe portion, a heel portion, a rear portion, a front portion with a strike face, a top portion, and a sole portion, the body portion defining a periphery of the golf club head, a first visual guide portion, a second visual guide portion, and a third visual guide portion on the body portion, each of the first, second and third visual guide portions comprising a plurality of weight portions extending between the front and rear portions with each weight portion disposed in one weight port of a plurality of weight ports on the body portion, adjacent weight ports being separated by a port distance less than the port diameter of any of the two adjacent weight ports, the third visual guide portion located in a recess portion on the top portion and being located substantially equidistant from the first and second visual guide portions;

wherein at least a portion of the first visual guide portion is disposed at or proximate to the toe portion between the strike face and the periphery of the golf club head, wherein at least a portion of the second visual guide portion is disposed at or proximate to the heel portion between the strike face and the periphery of the golf club head, and wherein a distance between the first visual guide portion and the second visual guide portion in a direction substantially parallel to the face portion is less than or equal to a diameter of a golf cup and greater than a diameter of a golf ball.

17. A putter-type golf club head as defined in claim 16, wherein at least a portion of each of the first and second visual guide portions are visible to an individual in an address position.

18. A putter-type golf club head as defined in claim 16, wherein the first and second visual guide portions are substantially congruent.

19. A putter-type golf club head as defined in claim 16, wherein at least a portion of the first visual guide portion extends between the rear portion and the front portion substantially similar to a contour of the periphery at or proximate to the toe portion, and wherein at least a portion of the second visual guide portion extends between the rear portion and the front portion substantially similar to a contour of the periphery at or proximate to the heel portion.

20. A putter-type golf club head as defined in claim 16, wherein the weight ports of the first visual guide portion are located less than 0.5 inch (12.7 mm) from the periphery at or proximate to the toe portion, and the weight ports of the second visual guide portion are located less than 0.5 inch (12.7 mm) from the periphery at or proximate to the heel portion.

* * * * *